US005094209A

United States Patent [19]

Kishida et al.

[11] Patent Number: 5,094,209

[45] Date of Patent: Mar. 10, 1992

[54] IGNITION CONTROL SYSTEM FOR A FUEL INJECTION INTERNAL COMBUSTION ENGINE

[75] Inventors: Masayuki Kishida, Gose; Noboru Takagi, Toyota, both of Japan

[73] Assignees: Fujitsu Ten Limited, Hyogo; Toyota Jidosha Kabushiki Kaisha, Aichi, both of Japan

[21] Appl. No.: 718,293

[22] Filed: Jun. 20, 1991

[30] Foreign Application Priority Data

Jun. 29, 1990 [JP] Japan ..... 2-172261

[51] Int. Cl.[5] ..... F02P 5/14

[52] U.S. Cl. ..... 123/422; 123/416; 123/492

[58] Field of Search ..... 123/416, 422, 492, 493, 123/480, 488, 494, 435; 364/431.05

[56] References Cited

U.S. PATENT DOCUMENTS

| | | | |
|---|---|---|---|
| 4,232,642 | 11/1978 | Yamaguchi et al. | 123/416 |
| 4,886,030 | 12/1989 | Oba et al. | 123/422 |
| 4,909,224 | 3/1990 | Nishiyama et al. | 123/492 |
| 4,932,376 | 6/1990 | Linder et al. | 123/422 |
| 4,947,816 | 8/1990 | Nakamura et al. | 123/422 |
| 4,957,088 | 9/1990 | Hosaka | 123/480 |
| 4,974,563 | 12/1990 | Ikeda et al. | 123/494 |
| 4,981,126 | 1/1991 | Kurihara | 123/492 |
| 4,996,960 | 3/1991 | Nishiyama et al. | 123/435 |
| 4,996,965 | 3/1991 | Onari et al. | 123/492 |
| 5,002,029 | 3/1991 | Dietl | 123/422 |
| 5,040,509 | 8/1991 | Nakaki et al. | 123/422 |

FOREIGN PATENT DOCUMENTS

| | | |
|---|---|---|
| 50-22129 | 3/1975 | Japan . |
| 58-48738 | 3/1983 | Japan . |
| 59-165865 | 9/1984 | Japan . |
| 60-159372 | 8/1985 | Japan . |
| 62-3173 | 1/1987 | Japan . |
| 62-17368 | 1/1987 | Japan . |
| 1-280677 | 11/1989 | Japan . |
| 1-310146 | 12/1989 | Japan . |

*Primary Examiner*—Raymond A. Nelli
*Attorney, Agent, or Firm*—Oliff & Berridge

[57] ABSTRACT

A system for controlling an ignition timing control in a fuel injection internal combustion engine whereby, upon an acceleration of the engine, in addition to a synchronous injection carried out at a predetermined timing during one cycle of the engine, an asynchronous injection is carried out regardless of the timing at which the synchronous injection is obtained. An ignition timing is basically controlled to obtain a maximum combustion pressure. A control of the retarding of the ignition timing from the basic timing is obtained upon a detection of an acceleration condition. A degree of acceleration is determined from a total amount of the asynchronous injection, and an amount by which the ignition timing is retarded is varied in accordance with the detected degree of acceleration.

8 Claims, 11 Drawing Sheets

| |
|---|
| Fig. 4A |
| Fig. 4B |

IGNITION CONTROL SYSTEM FOR A FUEL INJECTION INTERNAL COMBUSTION ENGINE

BACKGROUND OF THE INVENTION

1. Field of the Invention

The present invention relates to an electronic control device for an ignition timing in a fuel injection type internal combustion engine.

2. Description of the Related Arts

In an electronic controlled fuel injection engine, fuel injections from injectors provided at each cylinder of the engine are basically carried out at predetermined timings in one cycle of the operation of the engine. Such fuel injections are therefore called synchronous injections, and are made in an amount which is determined so that a desired air-fuel ratio is obtained at a steady state condition of the engine in which the degree of the depression of a throttle valve remains substantially unchanged. Nevertheless, the amount of fuel determined by the synchronous injections becomes less than that required to obtain the desired air fuel when the engine is under an acceleration condition, and therefore, conventionally, an acceleration fuel enrichment correction is carried out to obtain a desired air-fuel ratio when the engine enters an acceleration condition. Such an acceleration fuel enrichment correction is obtained by asynchronous fuel injections, which are carried out immediately upon the detection of an acceleration. The asynchronous injection is carried out regardless of the timing in one cycle of the engine operation, and this is completely different from the synchronous injections which are carried out at predetermined timings in one cycle of the engine operation.

The asynchronous injection is used to obtain a desired air-fuel ratio during the acceleration condition so that a sufficient torque that will maintain a necessary acceleration performance is obtained. Such an asynchronous fuel injection, however, causes a too rapid increase in the engine torque, which causes a driver to feel an acceleration shock and the vehicle to be subjected to an undesirable back and forth movement, which adversely affect the driveability of the vehicle.

Therefore, it has been proposed, in addition to the asynchronous fuel injections upon the detection the acceleration condition, to control an ignition timing so that it is delayed with respect to an optimum timing for obtaining the maximum torque, and as a result of such a delay of the ignition timing, the rapid increase in the engine torque is suitably suppressed and a desired driveability is maintained.

In this prior art, a predetermined fixed amount of delay is applied only to the ignition timing when an acceleration condition is detected, regardless of the degree of acceleration. The acceleration is detected as a predetermined value of a change in a value of an intake pressure per unit of time, or by a throttle switch for detecting that a degree of opening of the throttle valve is larger than a predetermined value. Nevertheless, such a fixed amount of a retarding of the ignition timing, when determined to match a rapid acceleration, causes misfires during a mild acceleration, since the ignition timing is too far delayed. To avoid this disadvantage, it is possible to select a small value of the amount by which the ignition timing is retarded, but this has a drawback in that an acceleration shock is generated when the engine is under a rapid acceleration, since the delay in the ignition timing is too small, and thus the driveability is worsened.

SUMMARY OF THE INVENTION

Therefore, an object of the present invention is to provide a ignition system capable of improving a driveability during an acceleration condition of the engine.

Another object of the present invention is to provide an ignition system for an internal combustion engine, capable of suitably varying the amount by which the ignition timing is retarded in accordance with the degree of acceleration.

According to the present invention, a fuel injection internal combustion engine is provided, which comprises:

an engine body having cylinders;

an intake line for an introduction of intake air into the engine body;

an injector means for an injection of an amount of fuel forming an air-fuel combustible mixture to be introduced into the respective cylinders;

a spark plugs mounted at each of the cylinders for causing a combustion of the air-fuel combustible mixture;

an exhaust line for removing an exhaust gas resulting from a combustion in the respective cylinders;

means for detecting a predetermined timing during one cycle of the engine;

means for operating the injector so that an amount of fuel which is determined in accordance with the operating condition of the engine is injected from the injectors at a timing synchronous with said predetermined timing;

means for detecting an acceleration condition of the engine;

means for operating the injectors so that an amount of fuel is injected from the injectors when the acceleration condition is detected, regardless of said predetermined timing;

means for calculating a basic fuel ignition timing for obtaining a desired engine performance during an operating condition of the engine;

means for operating the spark plugs so that an ignition occurs at the calculated timing;

means for calculating an indication of the total amount of the asynchronous fuel injection upon acceleration;

means, responsive to at least the calculated total amount of the asynchronous injections, for determining the degree of acceleration, and;

means, responsive to the determined degree of acceleration, for obtaining a desired amount of correction of the retarded amount of the ignition timing with respect to the basic fuel ignition timing, thereby preventing a shock from occurring upon acceleration while obtaining a desired acceleration performance.

When the engine is under an acceleration condition, a total amount of fuel introduced into the cylinders corresponds to the amount of fuel injected by a synchronous injection plus the amount of fuel injected by an asynchronous injection. The correction of the retarding of the ignition timing is applied to the basic ignition timing, and the correction of the retarding of the ignition timing is obtained in accordance with the degree of acceleration determined by the total amount of fuel injected by the asynchronous injection. When a rapid acceleration is determined, a large amount of correction of the retarding of the ignition timing is obtained, and thus a large shock and undesirable back and forth movement during the rapid acceleration is suppressed. Contrary to this, when a mild acceleration is determined, where such a shock and undesirable movement is small, a small amount of correction of the retarding of the ignition timing is applied, to prevent the engine from stalling.

DESCRIPTION OF A PREFERRED EMBODIMENT

Figure 1:
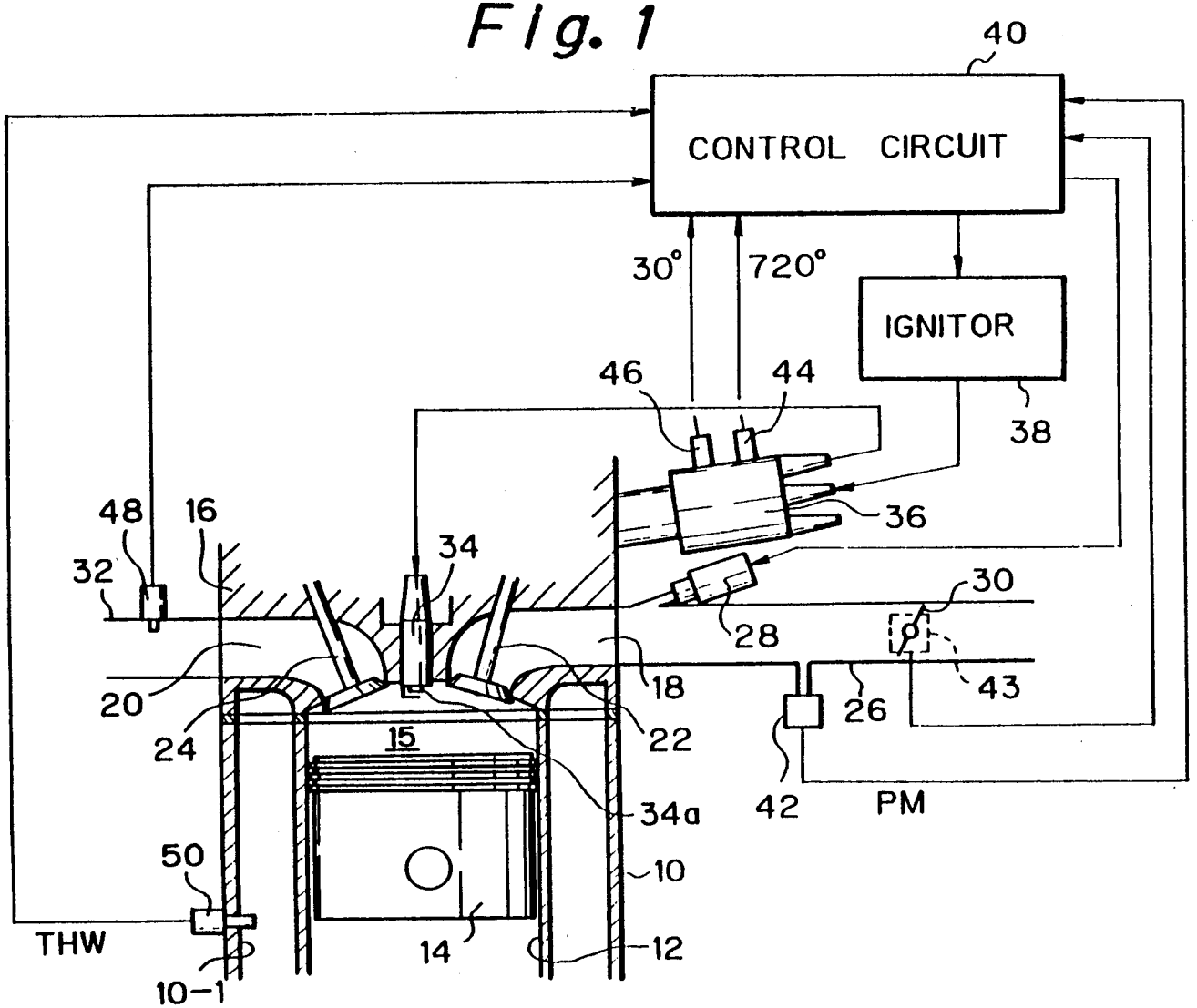
FIG. 1 is a schematic view of a fuel injection internal combustion engine according to the present invention.

In FIG. 1, which shows a construction of an electronically-controlled fuel injection engine, reference numeral 10 denotes a cylinder block, and cylinder bores 12 are formed in the cylinder block 10, and in each thereof a piston 14 is reciprocally accommodated so that a combustion chamber 15 is formed between the cylinder block 10, piston 14, and a cylinder head 16. The cylinder head 16 is mounted on the cylinder block 10, and an intake port 18 and an exhaust port 20 are formed the cylinder block 16. An intake valve 22 and exhaust valve 24 are arranged at the ends of the intake port 18 and exhaust port 20, respectively. An intake port 18 is connected to an intake pipe 26 in which an injector 28 and a throttle valve 30 is arranged, and the exhaust port 20 is connected to an exhaust pipe 32. A spark plug 34 having a spark gap 34*a* is connected to the cylinder head 16, and is arranged in the top of the combustion chamber 15. Reference numeral 36 denotes a distributor for controlling a connection of an ignitor 38 having an ignition coil (not shown) to a spark plug 34 at each cylinder.

A control circuit 40 controls an ignition timing operation and a fuel injection control, and is constructed as a microcomputer unit, and various sensors for a detection of engine operating conditions are connected to the control circuit 40. An intake air pressure sensor 42 detects an intake pressure PM in the intake pipe 26 at a position downstream of the throttle valve 30; a throttle sensor 43 detects a degree of opening of the throttle valve 30; and first and a second crank angle sensors 44 and 46 are arranged on the distributor 36. The first crank angle sensor 44 issues a pulse signal at every 720 degrees rotation of the crankshaft of the engine, and the second crank angle sensor 46 issues a pulse signal at every 30 degrees the rotation of the crankshaft. An air-fuel ratio sensor 48 is arranged in the exhaust pipe 32 for detecting an air-fuel ratio of the combustible mixture introduced into the engine combustion chamber 15. An engine cooling water temperature sensor 50 is connected to the cylinder block 10 such that it is in contact with engine cooling water in an cooling water jacket 10-1 of the engine body, to thus detect the temperature THW of the engine cooling water.

Figure 2:
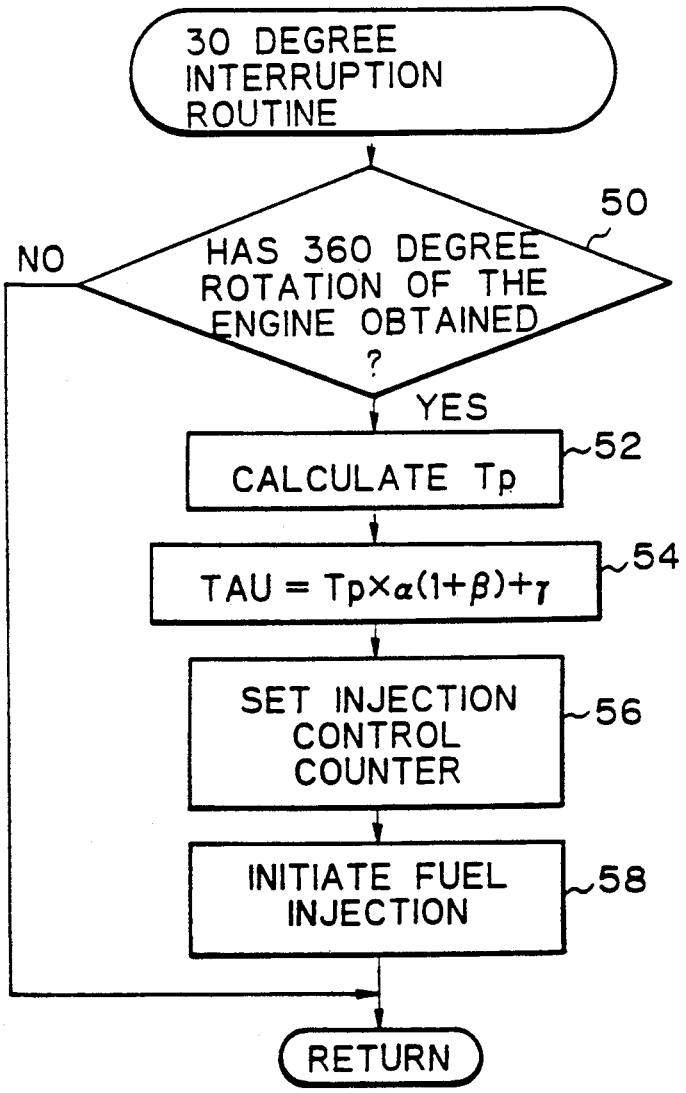
FIGS. 2, 3A, 3B, 4A, 4B, 5 and 6 are flowcharts illustrating the operation of the control circuit in FIG. 1.

Now, an operation of the control circuit 40 for controlling the fuel injection and ignition timing will be described with reference to flow charts shown in FIGS. 2 to 6. In this embodiment, the fuel injection is an all-cylinder simultaneous injection type, wherein the injectors 28 at all of the engine cylinders are operated simultaneously at predetermined timings during each cycle of the engine operation. In this embodiment, the injectors 28 of all of the cylinders execute a fuel injection at every 360 degrees of rotation of the crankshaft, i.e., a half cycle of the engine operation. FIG. 2 is a schematic view of a flow chart for executing a fuel injection from the injectors 28, which routine is carried out at the timing at which the pulse signals at each 30 degrees rotation of the crankshaft are output by the second crank angle sensor 46. At step 50, it is determined if a rotation of 360 degrees has occurred after the preceding fuel injection has been carried out. When the result at step 50 is NO, the following steps are bypassed. When it is determined that the 360 degrees of rotation has occurred after the preceding fuel injection, the routine goes to step 52, and a basic fuel injection amount Tp is calculated from the engine speed NE calculated from a time difference in the arrival of adjacent 30 degrees signals from the sensor 46 and an intake pressure PM detected by the sensor 42, as an indication of an engine load. Tp denotes a duration of the opening of the injector 28 for injecting a fuel injection amount by which a stoichiometric air-fuel ratio is obtained at this engine speed and engine load. Then, at the following step 54, a final fuel injection amount TAU is calculated by $$TAU = Tpx\ \alpha(1+\beta)+\gamma,$$

where $\alpha$, $\beta$ and $\gamma$ denote, generally, a correction amount or correction factor for correcting the basic fuel injection amount Tp in accordance with various engine requirements, such as an engine cold state, a detailed description of which is omitted as it is not closely related to the present invention.

At step 56, the calculated final fuel injection period is set to a fuel injection control down counter provided in the control circuit 40. This down counter is set for a period corresponding the final fuel injection amount, and is reset when the countdown is completed. At step 58, a signal is output to the fuel injectors 28 at all of the cylinder, to commence a fuel injection thereby. When a fuel injection of the calculated amount TAU is completed, the downcounter is reset, and thus the fuel injection (synchronous injection) at this timing is finished.

Figure 3A:
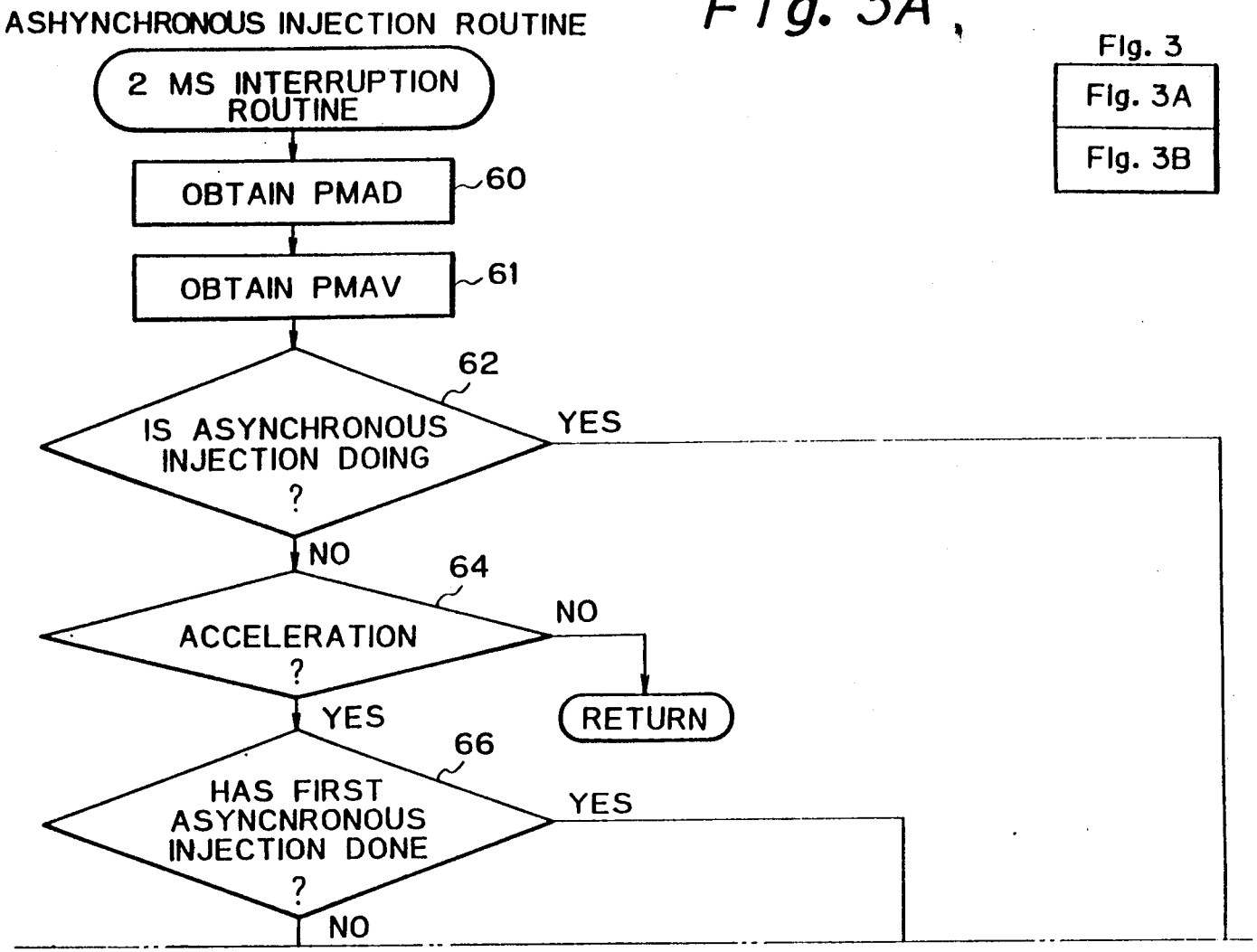
Figure 3B:
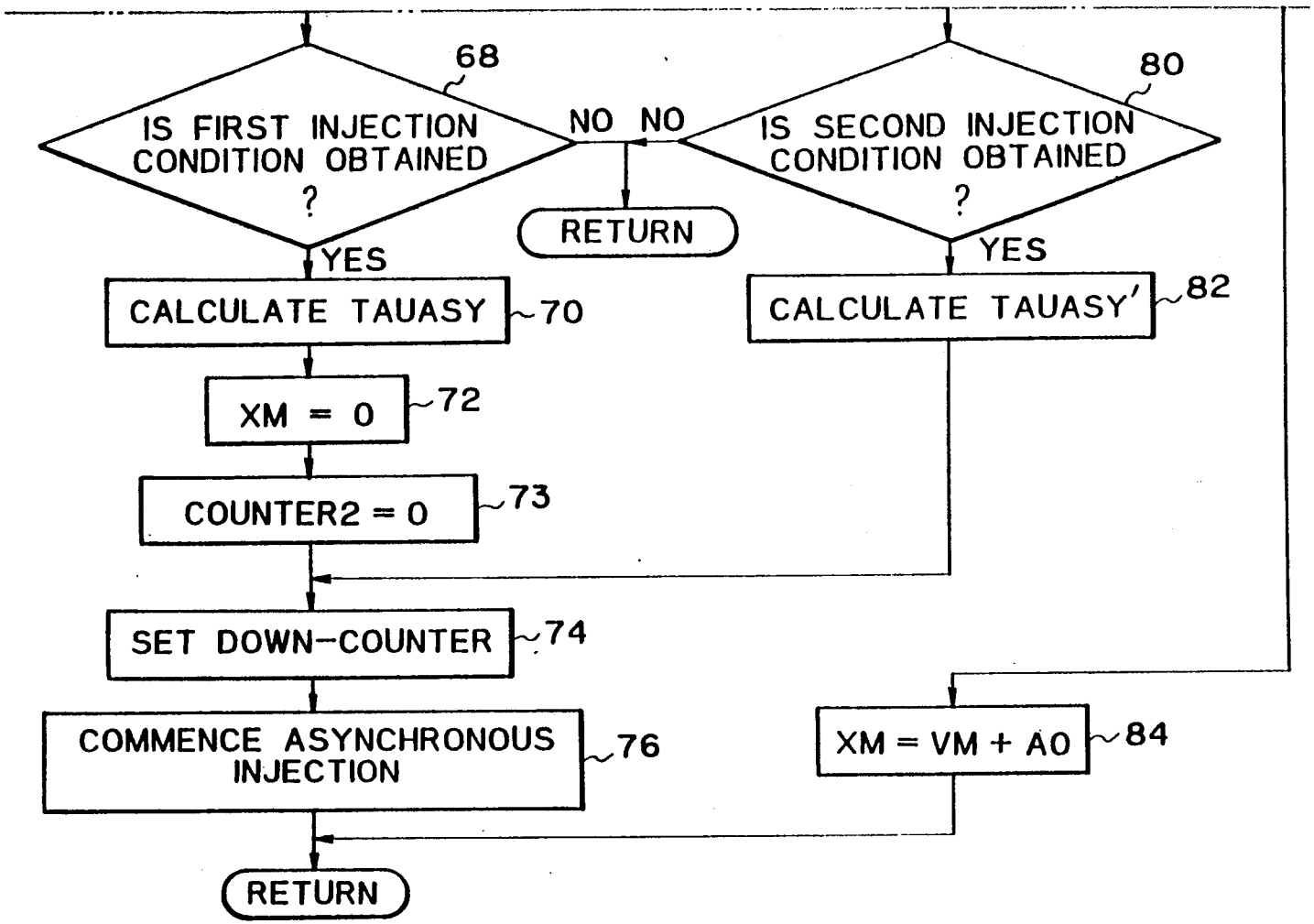

FIG. 3 shows a interruption routine carried out at intervals of 2 milliseconds. This routine basically executes an analogue-to-digital conversion of analogue signal from the intake pressure sensor 42, to obtain a digital value PMAD of the intake pressure PM in the engine intake pipe 26, as detected. At step 60, an analogue-to-digital conversion of signal from the intake pressure sensor 42 is carried out to obtain a digital value of the intake pressure, PMAD, and at step 61, a blunt value of an intake pressure PMAV corresponding to an average value of the intake pressure values during a predetermined period is calculated by using a predetermined formula in a manner well known to those skilled in this art. Then, at step 62, it is determined if an asynchronous injection is now underway, and when it is determined that an asynchronous fuel injection is not underway, the routine goes to the steps following step 64 and an asynchronous fuel injection control is carried out. At step 64, it is determined if the engine is under an acceleration condition at an engine speed NE smaller than a predetermined value, such as 4,000 revolutions per minute. Such a determination of an acceleration is obtained by a change in the intake pressure to larger than a predetermined value. When it is determined that the engine is not under an acceleration condition, the routine is returned to a main routine. When it is determined that the engine is under an acceleration condition, the routine goes to step 66 and it is determined if the first injection for this acceleration has been carried out. As will be understood later, an asynchronous injection is composed of a series of injections made upon a detection of an acceleration condition, for obtaining a total amount thereof which matches the degree of acceleration. When the result is NO at step 66, the routine goes to step 68 and it is determined whether a first injection condition has been obtained. This determination is obtained, for example, when $$PMAD - PMAD0 \geqq LVL,$$

where PMAD0 is a blunt value of an intake pressure PM upon the execution of preceding synchronous injection, and LVL is a threshold level of a predetermined value for executing the first injection. Namely, the first injection is carried out when the value of LVLTRN of the intake pressure PMAD becomes higher than the intake pressure PMAD0 during the preceding synchronous injection.

Figures 7A, 7B, 7C, 7D:
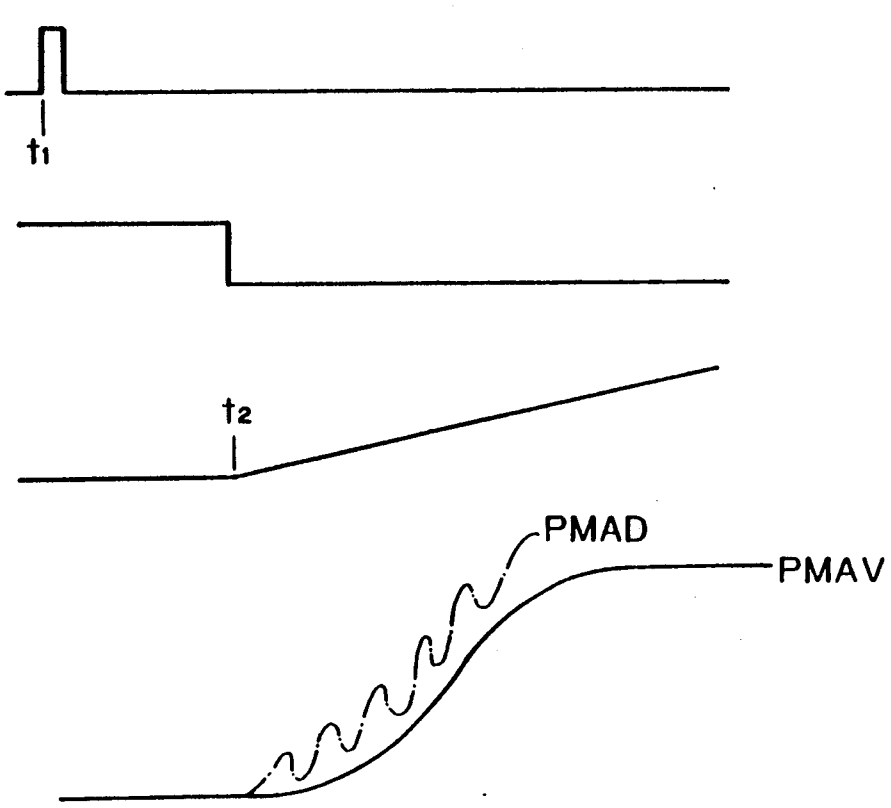
FIGS. 7 (a) to (k), and (d') to j') are timing charts illustrating the operation of the control circuit in FIG. 1.
Figures 7D, 7E, 7F, 7G, 7H, 7I, 7J, 7K:
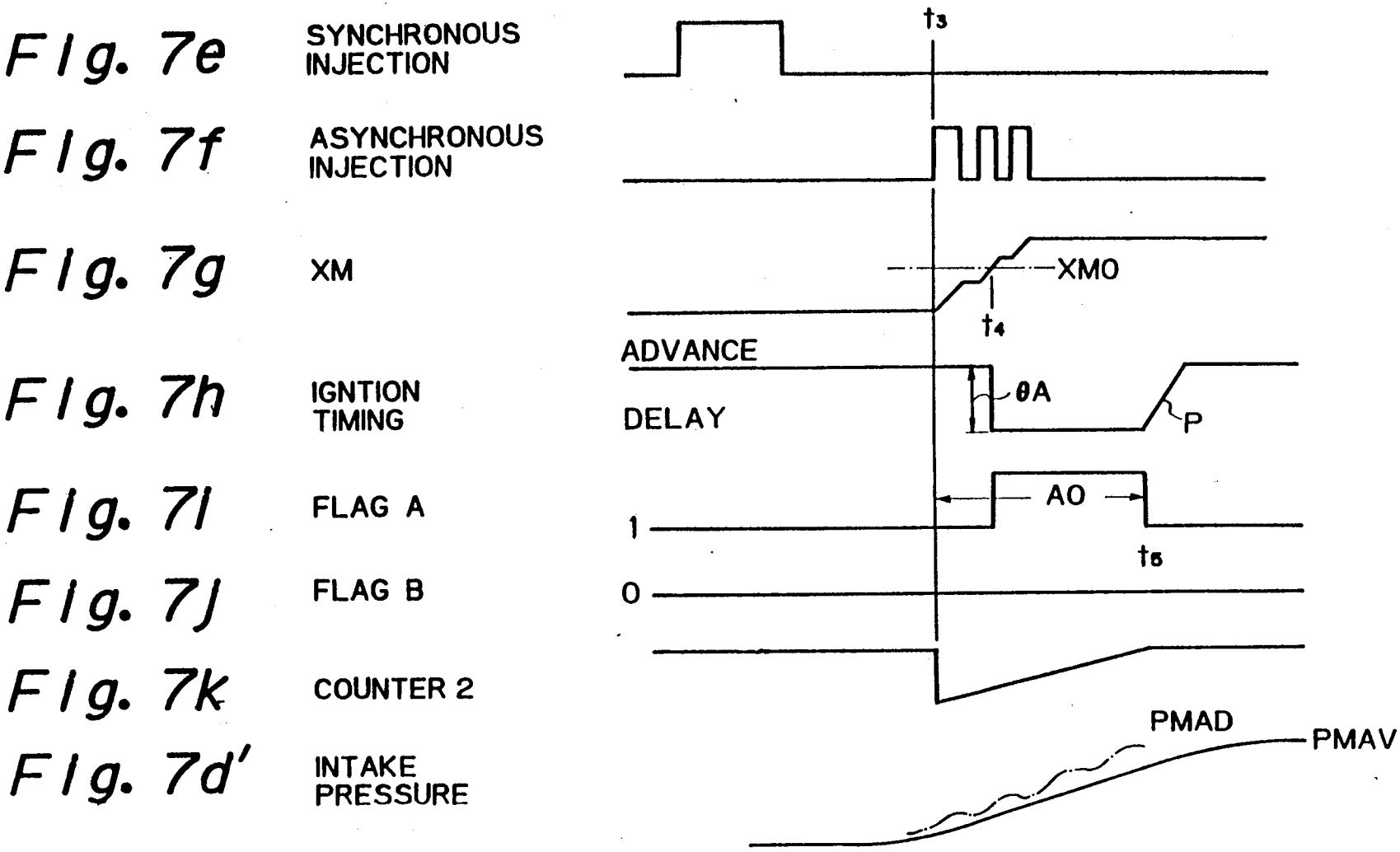
Figures 7E, 7F, 7G, 7H, 7I, 7J:
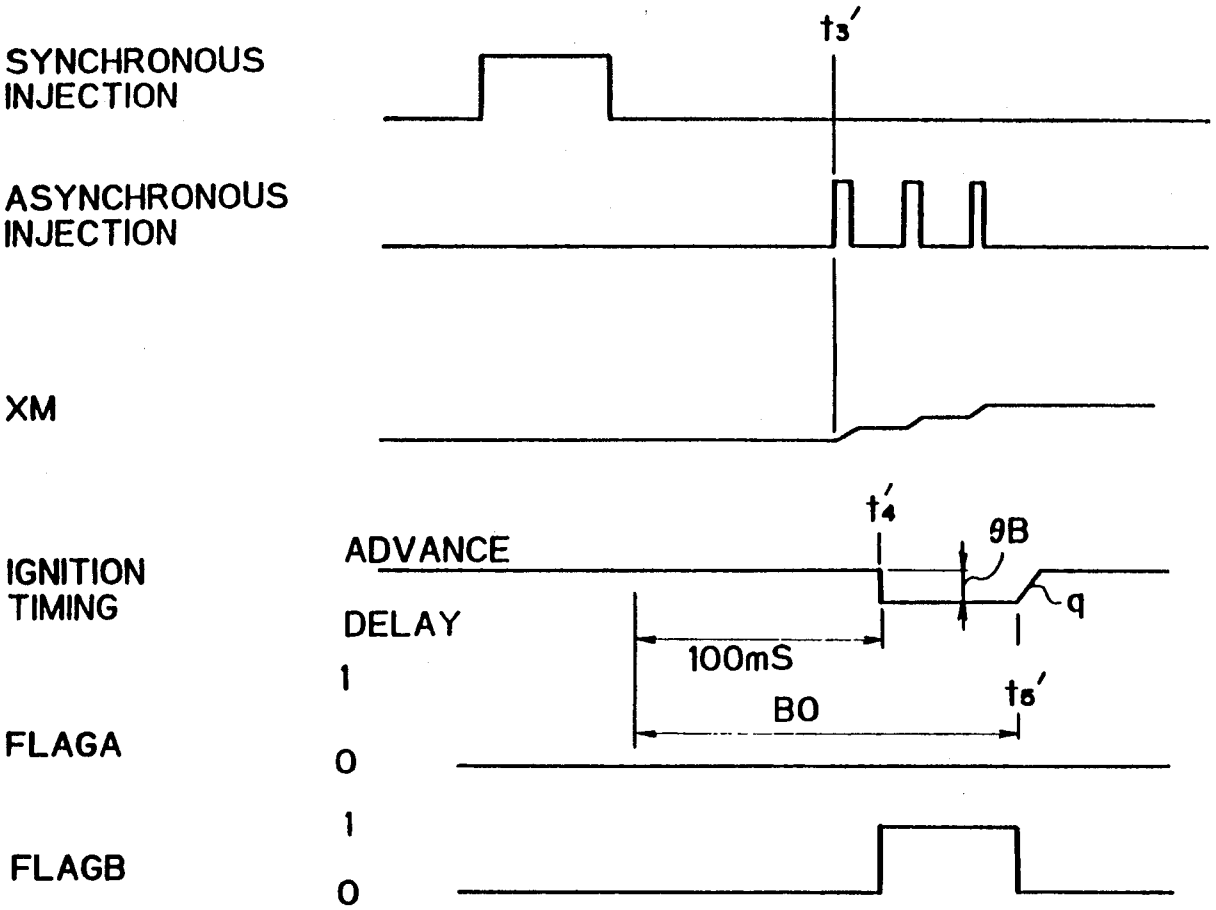

When it is determined that the first injection condition has been obtained, the routine goes to step 70 and an amount of the first injection TAUASY is calculated. This amount TAUASY is calculated based on the intake pressure when an acceleration is detected, and at step 72, a counter XM for counting a total value of the amount of asynchronous injection for this acceleration is cleared. Referring to FIG. 7-(g), this shows how the value of the XM is changed during the acceleration process. As will be fully described later, the total amount of the asynchronous injection indicates the degree of acceleration and is used for controlling an amount by which the ignition timing is retarded during the acceleration, according to the present invention. At step 73, a COUNTER2 (FIG. 7-(k)) for measuring the time from the commencement of the asynchronous injection is cleared; this is used for cancelling the ignition timing control for a rapid acceleration at step 151 in FIG. 4. At step 74, the ignition control down counter (not shown) in the control circuit 40 receives the value of the first injection TAUASY, and at step 76, an asynchronous fuel injection from the injectors 28 is commenced. When the calculated amount of fuel, TAUASY, has been injected, the downcounter is reset and the first asynchronous injection is stopped.

When the acceleration state of the engine continues regardless of the first injection, a YES result is obtained at step 66 and the routine goes to step 80, where it is determined that a second injection condition has been obtained. This determination is obtained when $$PMAD - PMAD0' \geqq LVL'$$

where PMAD0' is the value of the intake pressure PMAD at the preceding injection in this asynchronous injection process, and LVL' is a threshold level of a predetermined value, which corresponds, for example, to a predetermined increase in the intake pressure of 80 mmHg. When a YES result is obtained at step 80, the routine goes to step 82 and an amount of the second injection TAUASY' is calculated, and then goes to the previous mentioned steps 74 and 76 to carry out the second and subsequent asynchronous injections.

When it is determined at step 62 that the asynchronous injection process is being executed, i.e., the first or second or subsequent injection is being made, the routine goes to step 84 and the value of the XM is incremented for A0, which corresponds to the interval at which the routine in FIG. 2, is executed, i.e., 2 milliseconds. Namely, the value of XM (FIG. 7-(g)) shows a total amount of the asynchronous injection for this acceleration, and this will be used for a control of the ignition timing, as described later.

FIG. 7-(a), and (d) to (g) schematically illustrate the operation of the fuel injection. As shown, a timing signal for a synchronous injection (FIG. 7-(a)) is output at every 360 degrees rotation of the crankshaft. FIG. 7-(e) shows the synchronous injection thus occurred, and an acceleration causes the intake pressure to be increased as shown by FIG. 7-(d), wherein the solid line shows a blunt value PMAV of the intake pressure and the dotted line shows an instant value PMAD of the intake pressure when analogue-to-digital converted. A series of asynchronous injections is carried out as shown in FIG. 7-(f) for as long as the acceleration continues. FIG. 7-(g) shows the changes in XM indicating the total asynchronous injection amount.

Figures 4, 4A:
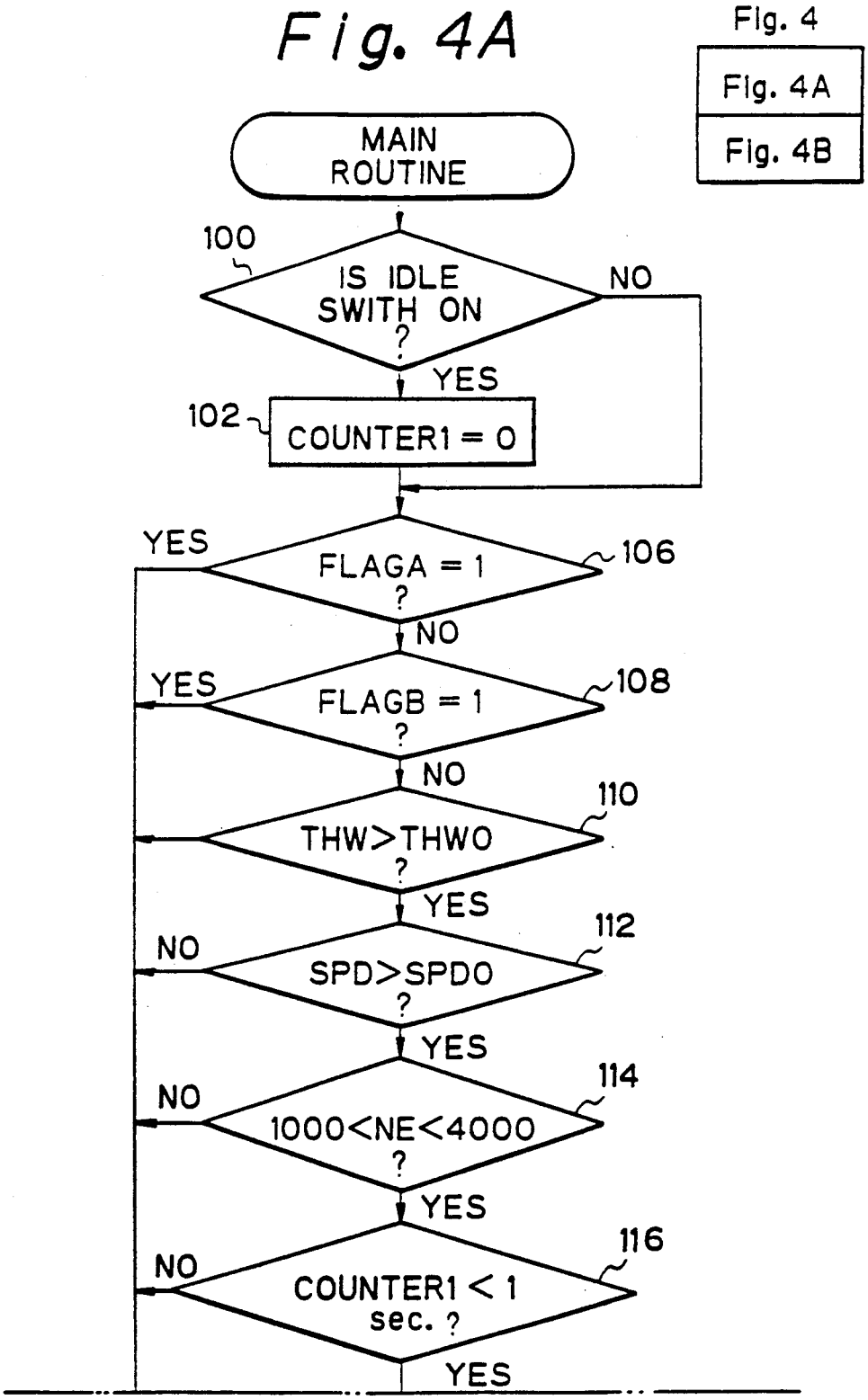
Figure 4B:
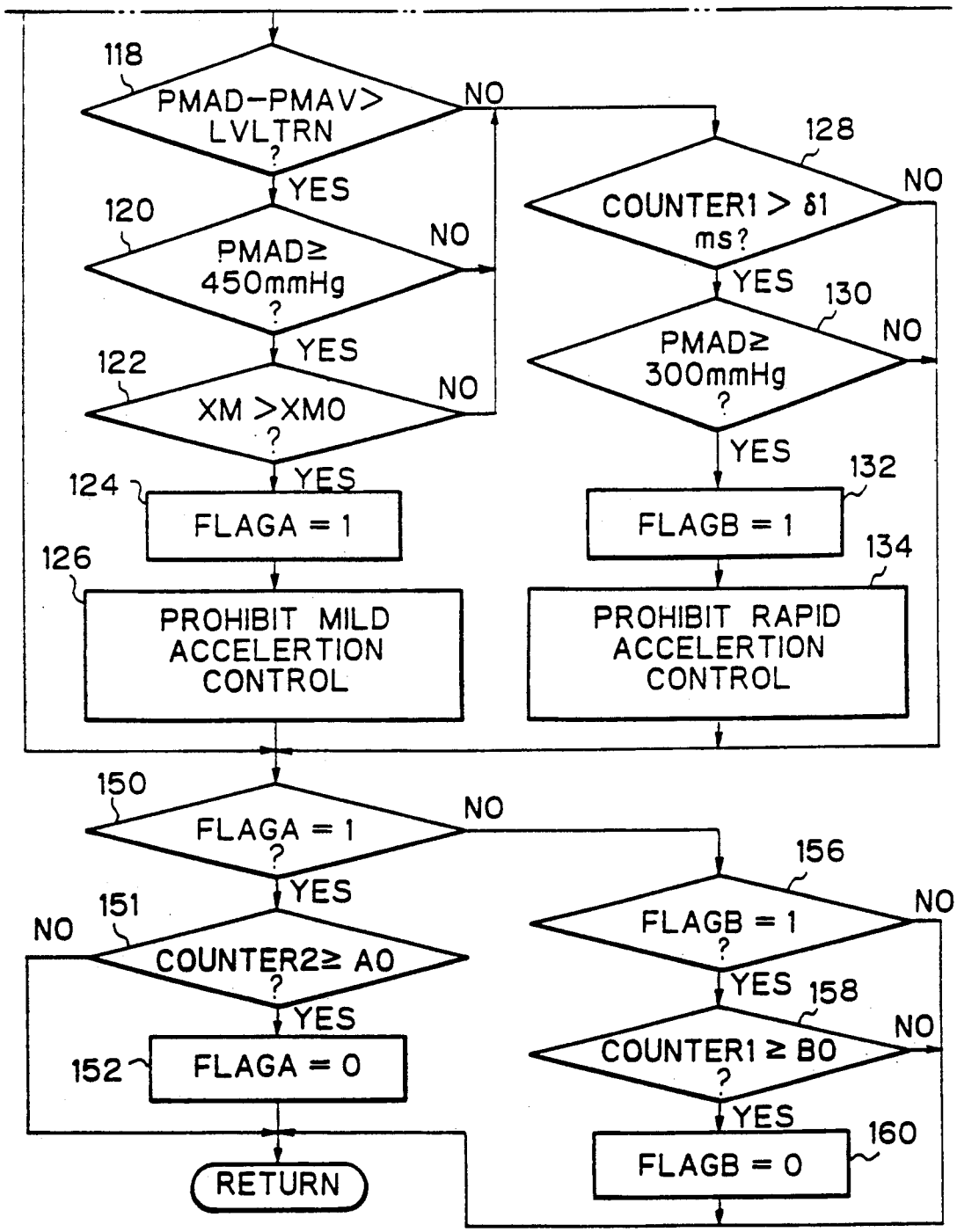

FIG. 4 shows a routine for controlling the flags used for the control of the ignition timing so that an amount by which the ignition timing is retarded is controlled in accordance with the degree of acceleration. This routine is carried out in a main routine which is repeated as long as the engine is operated. At step 100, it is determined if an idle switch provided in the sensor 43 is ON. This switch is made ON when the throttle valve 30 is in the idle position, and is made OFF when the accelerator pedal is depressed to open the throttle valve 30 from the idle position. When it is determined that the idle switch is ON, i.e., the throttle valve 30 is in the idle position, the routine goes to step 102 and a value of COUNTER1 is cleared. This value is used for measuring the duration of the time after the accelerator pedal is depressed to open the throttle valve 30. See FIG. 7-(c). When it is determined that the idle switch is OFF, i.e., the throttle valve has been opened from the idle position, the routine by passes step 102 and goes to step 106.

At step 106, it is determined if FLAGA is set; FLAGA is set when the ignition is retarded during a rapid acceleration. When it is determined FLAGA=0, i e., the ignition has not been retarded for a rapid acceleration, the routine goes to step 108 and it is determined if FLAGB is set; FLAGB is set when the ignition is retarded during a mild acceleration. When it is determined that FLAGB=0, i.e., the ignition has not been retarded for a mild acceleration, the routine goes to the steps following step 110.

At steps 110 to 116, it is determined whether the engine is under a condition at which the ignition should be retarded upon an acceleration, according to the present invention. At step 110, it is determined if the engine cooling water temperature THW detected by the sensor 50 is higher than a predetermined temperature THWO, for example, 60 degrees centigrade. When the engine is cold, the following steps are bypassed. At step 112, it is determined if the vehicle speed SPD is higher than a predetermined value SPD0. When the vehicle is stopped, the following steps are bypassed. At step 114, it is determined if the engine speed NE is between 1,000 r.p.m. and 4,000 r.p.m. When the engine speed NE is out side this range, the routine following step 116 is bypassed. At step 116, it is determined if the value of the COUNTER1 is smaller than 1 second, i.e., one second has not elapsed from the time at which the accelerator pedal was depressed. When 1 second has elapsed from the start of the acceleration, the following routine is bypassed. This allows a retarding of the ignition timing just after the start of the acceleration. When all of the requirements at steps 110 to 116 are satisfied, the routine goes to the steps following step 118.

At steps 118 to 122, it is determined whether the engine is under a rapid acceleration, to obtain a large value of the retarding of the ignition timing. At step 118, it is determined if the value of the intake pressure PMAD is larger than an average value PMAV of the intake pressure, for a value of LVLTRN. When the result is NO at step 118, i.e., the engine is not under a rapid acceleration, the following step is bypassed. At step 120, it is determined whether the intake pressure PMAD is larger than a predetermined value, such as 450 mmHg, which value is determined as the value of the intake pressure where a sharp increase in the engine output torque is obtained. It should be noted that the acceleration retard control should be carried out in this zone of the intake pressure. When it is determined that the intake pressure is not larger than the predetermined value, the following routine is bypassed. At step 122, it is determined if the total amount of the asynchronous injection XM calculated at the previous mentioned step 84 in FIG. 3 is larger than a predetermined value XM0; XM corresponds to a degree of the acceleration. A large ignition timing retarding value causes misfiring when the degree of acceleration is not large. Therefore, when the total amount of asynchronous injection is smaller than XM0, the following routine is bypassed.

When all of the requirements at steps 118 to 122 are met, it is then considered that the engine is under a rapid acceleration and a large value of the retardinq of the ignition timing upon a rapid acceleration is required, and the routine goes to step 124 where FLAGA is set to allowing the ignition to be retarded for a rapid acceleration. At step 126, an ignition control during a mild acceleration is prohibited, which prevents an ignition timing control for a mild acceleration from being additionally carried out when the ignition timing control for a rapid acceleration is commenced. Such an additional ignition timing control would otherwise cause an excessive increase in the delay of the ignition timing, which would cause the engine torque to be lowered and thus the vehicle would be subjected to an undesirable back and forth movement. To obtain such a prohibition, a value of the COUNTER1 is changed so that a requirement at step 158 (explained later) is automatically obtained to obtain the FLAGB=0, to thus prohibit a delay of the ignition timing for a mild acceleration.

At steps 128 to 130, it is determined whether a mild accelerating condition at which a small value of the retarding of the ignition timing is obtained. At step 128, it is determined if the value of the COUNTER1 is larger than 100, i.e., a time longer than δ1 (for example, 100 milliseconds) has elapsed from the start of the acceleration. The value of δ1 corresponds to a timing at which the engine torque is greatly increased after the start of the acceleration. The value of the δ1 can be calculated from a gear position of a transmission of the vehicle. Namely, a retarding of the ignition timing is started after an elapse of 100 milliseconds. When it is determined that 100 milliseconds have not elapsed from the start of the acceleration, the retarding for the mild acceleration is bypassed. At step 130, it is determined whether the value of the intake pressure PMAD is larger than a predetermined value such as 300 mmHg. When it is determined that the value of the intake pressure PMAD is smaller than 300 mmHg, the ignition timing is not retarded. Contrary to this, when 100 milliseconds has elapsed from the commencement of the acceleration and the value of the intake pressure PMAD is larger than 300 mmHg, the routine goes to step 132 and FLAGB is set to allow the retarding for a mild acceleration to commence. At step 134, a retarding of the ignition timing for a rapid acceleration control is prohibited. This is to prevent the ignition timing control for a rapid acceleration from being additionally carried out when the ignition timing control for a mild acceleration is commenced. Such an additional ignition timing control would otherwise cause an excessive increase in the delay in the ignition timing. To obtain such a prohibition, a value of the COUNTERl is changed so that a requirement at step 151 (explained later) is automatically obtained to obtain the FLAGA=0, to thus prohibit an ignition timing delay for a rapid acceleration.

When the retarding for a rapid acceleration is started by setting FLAGA at step 124, the result of the determination at the step 106 at the following timing is YES, and thus the routine bypasses the steps following step 108. Similarly, when the retarding for a mild acceleration is commenced by setting FLAGB at step 132, the result of the determination at step 108 at the following timing is YES, and thus the routine bypasses the steps following step 110.

In FIG. 4, the steps following step 150 are used for determining whether a cancellation of the acceleration retard control should be made, according to the present invention. At step 150, it is determined if the FLAGA is set (1). When it is determined that FLAGA=1, i.e., the ignition timing is retarded during the rapid acceleration, the routine goes to step 152 and it is determined if the COUNTER2 is larger than A0; this counter detects the time lapsed after the start of the asynchronous injection, and the time A0 can be calculated from a map based on a gear position. Namely, the time A0 corresponds to a timing at which the engine torque upon surging is lowered. When a NO result is obtained, the retarding of the ignition timing is maintained. When the predetermined time has elapsed from the start of the acceleration, the routine goes to step 152 and the flag FLAGA is reset, to cancel the retarding of the ignition timing for the rapid acceleration. It should be noted that it is possible to introduce a determination that the retarding of the ignition timing is cancelled when the throttle valve is in a fully closed position (idling position) within the above period from the start of the depression of the accelerator pedal.

When it is determined that the FLAGA=0 at the step 150, i.e., the ignition timing is not retarded for the rapid acceleration, the routine goes to step 156 and it is determined if the FLAGB is set (1). When it is determined that FLAGB=1, i.e., the retarding of the ignition timing during the mild acceleration is carried out, the routine goes to step 158 and it is determined whether the COUNTER1 is larger than B0; this counter detects a time elapsed after the depression of the accelerator pedal. The B0 can be calculated in the same manner as for A0. When a NO result is obtained, the retarding of the ignition timing is maintained. When COUNTER1≧B0, i.e., a predetermined time has elapsed from the start of the acceleration, the routine goes to step 160 and the flag FLAGB is reset, to cancel the retarding of the ignition timing for the mild acceleration. It should be noted that, at step 158 for determining the timing for ending the retarding of the ignition timing upon a mild acceleration, the COUNTER1 measures the time not from the start of the asynchronous injection but from the start of the depression of the accelerator pedal from the idling position, as a situation may arise in which an asynchronous injection is not carried out for a mild acceleration.

Figure 5:
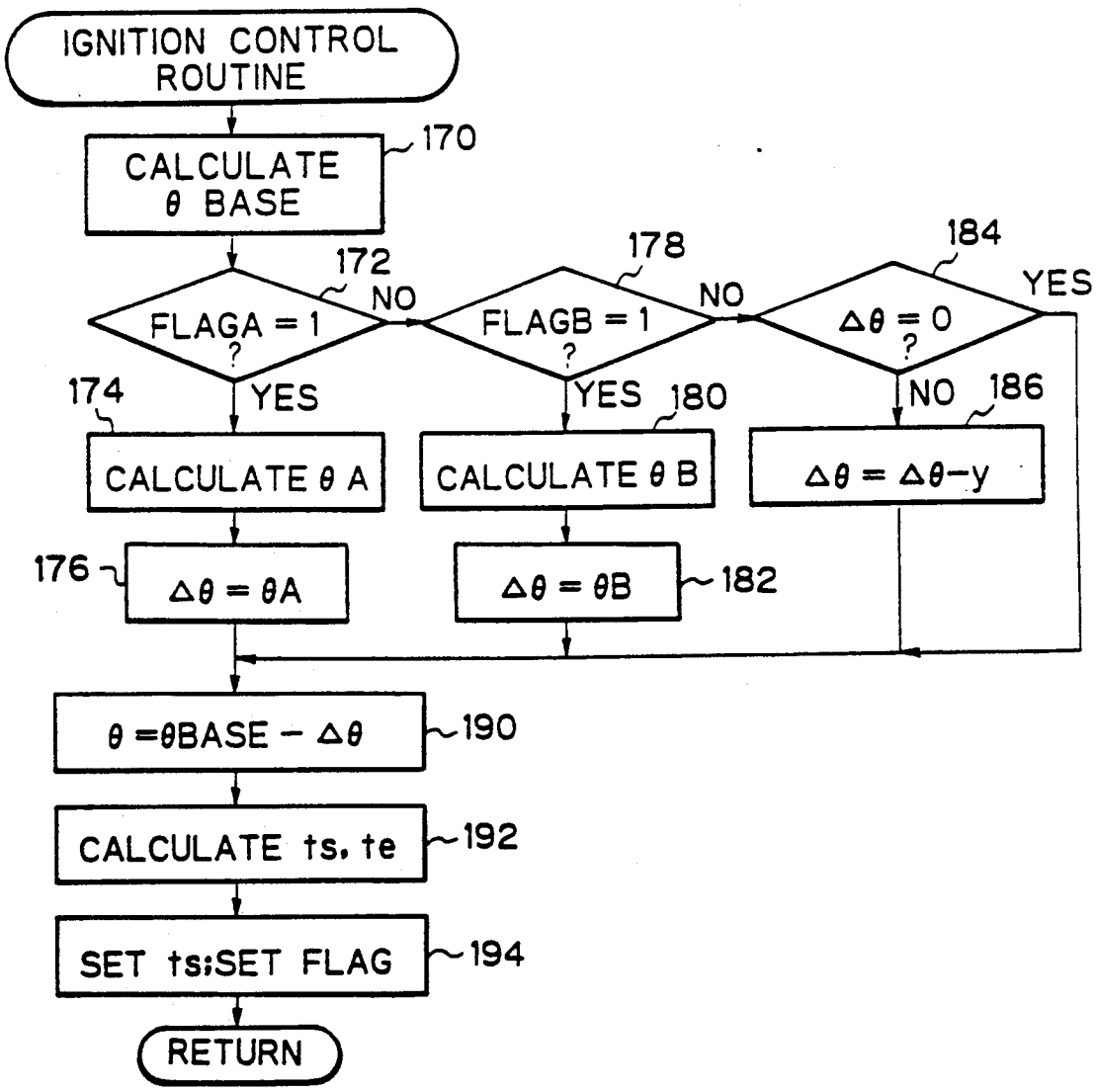
Figure 6:
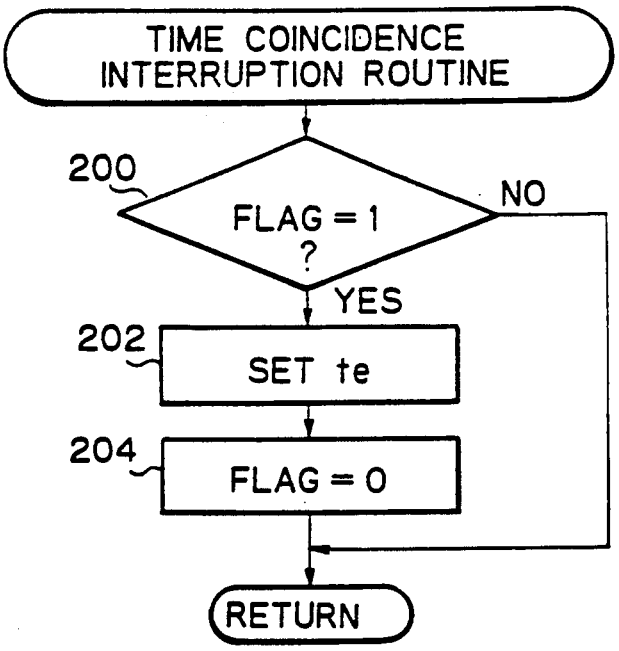

FIG. 5 shows an ignition control routine which is executed at every 30 degrees rotation of the crankshaft in accordance with a signal from the sensor 46. At step 170, a basic fuel injection timing θBASE is calculated by a well known map interpolation technique. As is well known, a map of the basic ignition timing θBASE as an angle from a top dead center of the piston during a compression stroke is used to obtain the maximum engine torque for combinations of the engine speed NE and intake pressure PM as an engine load, and as is well known, a map interpolation is carried out to obtain a value of the θBASE corresponding to a detected combination of the engine speed NE and intake pressure PM. At steps 172 to 186, the ignition timing delay amount Δθ is calculated, as described later. After the calculation of the ignition timing delay correction amount Δθ, the routine goes to step 190 and the final ignition timing θ is obtained by subtracting the delay correction value Δθ from the basic ignition timing θBASE. Namely, the ignition timing is delayed for a value of the Δθwith respect to the basic ignition timing θBASE, to obtain the maximum engine torque. At step 192, times ts and te for energizing and de-energizing, respectively, the ignitor 36 are calculated. As is well known, the control circuit 40 is provided with a compare register having two inputs, one of which is connected to a free run counter, and the value ts is set to the other input of the register at step 194. Also at step 194 FLAG is set. When the time ts is reached, the compare register outputs a signal to set the ignitor 38, and a time coincidence interruption routine in FIG. 6 is simultaneously commenced. At step 200, it is determined if FLAG is set. Initially the FLAG is set (step 194), and the routine then goes to step 202 and the time te is set to the compare register. At step 204, the FLAG is reset. When the time te is reached, the compare register outputs a signal to de-energize the ignitor, whereby a spark is obtained in the electrode 34a of the spark plug 34 to thus commence the ignition. This time te corresponds, of course, to the ignition timing θ calculated at step 190.

At steps 172 to 186 in FIG. 5, the amount for which the ignition timing is retarded is calculated, in accordance with the degree of acceleration. At step 172, it is determined if FLAGA is set, and when it is determined that FLAG=1, i.e., the ignition timing must be retarded for a rapid acceleration, the routine goes to step 174 and a map interpolation calculation of an ignition delay amount θA for the rapid acceleration is calculated. Similar to the map of the base fuel ignition timing θBASE, a map of values of the delay amount θA is provided for combinations of the engine speed and engine load, and a map interpolation calculation is carried out to obtain a value of the θA which matches the detected engine speed and engine load. At step 176, the value of θA is moved to Δθ, which is an injection timing delay value in a general sense. As a result, a large delay in the ignition timing is obtained when the engine is under a rapid acceleration. As already explained, the large delay in the ignition timing upon a rapid acceleration is commenced by determining that the total amount of the asynchronous amount XM is larger than the predetermined value XM0 (step 122 in FIG. 4), to thus prevent the generation of a shock or any back and forth movement of the vehicle during the acceleration.

When it is determined that FLAGA=0, i.e., the ignition timing is not retarded for a rapid acceleration, the routine goes to step 178 and it is determined if FLAGB=1. When FLAGB=1, i.e., a mild acceleration is being carried out, the routine goes to step 180 and a map interpolation calculation of an ignition delay amount θB for the mild acceleration is calculated. Similar to the map of the base fuel ignition timing θBASE, a map of values of the delay amount θB is provided for combinations of the engine speed and engine load, and a map interpolation calculation is carried out to obtain a value of the θB which is matches the detected engine speed and engine load. At step 182, the value of θB is moved to Δθ, and as a result, a small amount of delay of the ignition timing is obtained when the engine is under a mild acceleration, and thus misfiring is prevented.

When FLAGB=0at step 178, i.e., the engine is not retarded for under either a rapid acceleration or a mild acceleration, the routine goes to step 184 and the ignition retarding correction amount is made zero. When the result is NO at step 184, i.e., a delay correction for a rapid acceleration or for mild acceleration has been carried out, the routine goes to step 186 and the value of Δθ is decremented by a predetermined value y. This means that, upon completion of the acceleration, the retarding correction amount is gradually lowered toward the basic ignition timing.

FIG. 7 shows the control of the retarding of the ignition timing according to the present invention. Asynchronous injection (e) is commenced at time t1. At time t2, the accelerator pedal is depressed to open the throttle valve 30 and bring the idle switch to the OFF position (b), causing the COUNTER1 to be incremented (c). When a rapid acceleration is carried out, a rapid increase in the intake pressure PMAD is obtained as shown in (d). At time t3, an asynchronous condition is obtained (YES at step 68 in FIG. 3), and an asynchronous injection process is commenced to obtain a series of asynchronous injections as shown in (f), which causes the integrated value XM of the asynchronous fuel injection to be calculated as shown in (g). At time t4, the integrated value XM exceeds the predetermined value XM0 (step 122 in FIG. 4), and the ignition timing is delayed and FLAGA set to 1 (i), whereby a large value of the ignition timing delay amount Δθ calculated from the first map θA is obtained as shown by (h) by the execution of step 176 in FIG. 5, and as a result, an ignition timing delayed with respect to the basic timing θBASE is obtained by the execution of step 190 in FIG. 5. At time t5, a predetermined time A0 measured by the COUNTER2 (k) by the execution of step 151 in FIG. 4 from the start of the asynchronous injection (t3) is obtained, so that the FLAGA is cleared to cancel the retarding of the ignition timing for the rapid acceleration (step 152 in FIG. 4). The ignition timing is then gradually returned to the basic timing θBASE, as shown by line p in FIG. 7-(h), by the execution of step 186 in FIG. 5.

When a mild acceleration carried out, a mild increase in the intake pressure PMAD is obtained as shown in FIG. 7-(d), and at time t3', an asynchronous injection condition is obtained to thus start the asynchronous injections as shown in FIG. 7-(f'). At time t4', a predetermined time δ1, such as 100 milliseconds, is obtained from the start of the depression of the accelerator pedal (YES result at step 128 in FIG. 4), whereby a ignition timing delay control condition is obtained to set FLAGB to 1 (j'), and thus a small value of the ignition timing delay amount $\Delta\theta$ calculated from the first map $\theta$B is obtained as shown by the execution of the step 180 in FIG. 5, and as a result, an ignition timing delayed with respect to the basic timing $\theta$BASE is obtained by the execution of the step 190 in FIG. 5. At time t5', a predetermined time B0 measured by the COUNTER1 (k) by the execution of the step 158 in FIG. 4, from the start of the depression of the accelerator pedal at time t2, is obtained and that the FLAGB is cleared to cancel the retarding of the ignition timing for the mild acceleration (step 160 in FIG. 4). The ignition timing is then gradually returned to the basic timing $\theta$BASE as shown by line q in FIG. 7-(h').

While embodiments of the present invention are described with reference to the attached drawing, many modification and changes can be made by those skilled in this art without departing from the scope and spirit of the present invention.

We claim:

1. A fuel injection internal combustion engine, comprising:

an engine body having cylinders;

an intake line for introducing intake air into the engine body;

an injector means for injecting an amount of fuel for forming an air-fuel combustible mixture to be introduced into the respective cylinders;

spark plugs mounted at each of the cylinders for causing a combustion of the combustible mixture;

an exhaust line for removing an exhaust gas resulting from a combustion in the respective cylinders;

means for detecting a predetermined timing during one cycle of the engine;

means for operating the injector so that an amount of the fuel which is determined in accordance with the operating condition of the engine is injected from the injectors at a timing synchronous with said predetermined timing;

means for detecting an acceleration condition of the engine;

means for operating the injectors so that an amount of fuel is injected from the injectors when the acceleration condition is detected, regardless of said predetermined timing;

means for calculating a basic fuel ignition timing for obtaining a desired engine performance during an operating condition of the engine;

means for operating the spark plugs so that an ignition occurs at the calculated timing;

means for calculating an indication of the total amount of the asynchronous fuel injection upon an acceleration;

means, responsive to at least the calculated total amount of the asynchronous injections, for determining the degree of acceleration, and;

means, responsive to the determined degree of acceleration determined by a total amount of said asynchronous fuel injection, for obtaining a desired amount of correction of the retarded amount of the ignition timing with respect to the basic fuel ignition timing, thereby preventing a shock from occurring upon acceleration while obtaining a desired acceleration performance.

2. A fuel injection internal combustion engine according to claim 1, wherein said amount of retarding correction means comprises means for comparing the calculated total amount of the asynchronous injection with a predetermined threshold value, to thereby determine whether a large total amount is obtained, first correction means for obtaining, for a desired period, a large amount of the retarding correction when it is determined that a large total amount of asynchronous injection is obtained, and second correction means for obtaining, for a desired period, a small value of the amount of the retarding correction when it is determined that a small total amount of the asynchronous injection is obtained.

3. A fuel injection internal combustion engine according to claim 2, wherein said first correction means for obtaining a large value of retarding correction comprises means for detecting a start of the asynchronous injection, means for detecting a predetermined elapse of time from the start of the asynchronous injection, which time is determined in accordance with an engine condition, and means for obtaining a large value of the retarding correction for the predetermined time.

4. A fuel injection internal combustion engine according to claim 2, wherein said second correction means for obtaining a small value of retarding correction comprises means for detecting a start of an acceleration, means for detecting an elapse of time from the start of the acceleration, and means for obtaining the small retarding correction value for the predetermined time.

5. A fuel injection internal combustion engine according to claim 2, further comprising means for prohibiting an execution of the retarding correction by the second retarding correction means once the retarding correction by the first means is obtained during an acceleration.

6. A fuel injection internal combustion engine according to claim 2, further comprising means for prohibiting an execution of the retarding correction by the first retarding correction means once the retarding correction by the second means is obtained during an acceleration.

7. A fuel injection internal combustion engine according to claim 3, wherein said retarding correction having a large value for a rapid acceleration is gradually decreased to zero after the predetermined time has elapsed.

8. A fuel injection internal combustion engine according to claim 4, wherein said retarding correction of small value for the mild acceleration is gradually decreased to zero after the predetermined time has elapsed.

* * * * *